US010065093B2

(12) United States Patent
Cohens

(10) Patent No.: US 10,065,093 B2
(45) Date of Patent: Sep. 4, 2018

(54) CAT'S CLAW GOLF TOOL WITH TREAD CLEANING

(76) Inventor: Clarence K. Cohens, Dallas, TX (US)

( * ) Notice: Subject to any disclaimer, the term of this patent is extended or adjusted under 35 U.S.C. 154(b) by 0 days.

(21) Appl. No.: 13/340,426

(22) Filed: Dec. 29, 2011

(65) Prior Publication Data

US 2012/0324670 A1 Dec. 27, 2012

(51) Int. Cl.
*A63B 57/60* (2015.01)
*A63B 57/00* (2015.01)

(52) U.S. Cl.
CPC ..... *A63B 57/00* (2013.01); *A63B 57/60* (2015.10)

(58) Field of Classification Search
CPC ..... A63B 57/00; A63B 57/60; A63B 57/50; A63B 57/207; A63B 57/353; A61B 15/0055; A61B 15/0081; A61B 2200/1066; A61B 2200/3073; A47L 23/04; A47L 23/08; A47L 23/14; A01D 7/00; A01D 7/02; A01D 7/06
USPC ..... 15/113, 237, 142, 143.1, 236.05–236.08, 15/37, 167.1; D32/47; 473/408, 286; D8/13
See application file for complete search history.

(56) References Cited

U.S. PATENT DOCUMENTS 1,239,687 A * 9/1917 Hanamma ..... A01D 7/06 56/400.17
1,723,616 A * 8/1929 Hawkins ..... A01D 7/02 56/400.01
2,244,098 A * 6/1941 Busick ..... 15/172
2,857,607 A * 10/1958 South ..... A47L 23/04 15/104.001
2,857,608 A * 10/1958 Schwartz ..... A63B 57/60 132/75.3
2,912,707 A * 11/1959 Fulton ..... A63B 57/60 15/105
D190,333 S * 5/1961 Gunderson ..... B44D 3/164 D21/795
3,045,270 A * 7/1962 Blumlo ..... A47L 23/04 15/216
3,049,182 A * 8/1962 Pelow ..... A63B 57/50 172/378
3,111,698 A * 11/1963 Reichle ..... A47L 23/04 15/105
D198,138 S * 5/1964 Langlie ..... D8/13
D203,659 S * 2/1966 Pleasants ..... D32/47
3,267,506 A * 8/1966 Van Patten ..... B25B 27/0035 15/104.011
3,983,628 A * 10/1976 Acevedo ..... A61C 7/02 433/24
4,096,629 A * 6/1978 Levine ..... B26B 1/00 30/152

(Continued)

*Primary Examiner* — Joshua J Michener
*Assistant Examiner* — Kyle J. Walraed-Sullivan
(74) *Attorney, Agent, or Firm* — Braxton Perrone, PLLC

(57) ABSTRACT

A golf tool for cleaning a cleat or spike may include a top surface, a pair of opposing side surfaces connected to the top surface, a bottom surface opposing the top surface, a front surface connecting to the top surface, the bottom surface and the side surfaces, and a back surface connecting to the top surface, the bottom surface and the side surfaces. The bottom surface may be connected to at least three cleaning fingers to simultaneously clean three cleats of a golf shoe. The front surface may be connected to a finger projection having a flexible cleaning cylinder.

7 Claims, 8 Drawing Sheets

(56) References Cited

U.S. PATENT DOCUMENTS 4,236,742 A * 12/1980 Florence ..... A01D 7/06 294/19.2
4,483,133 A * 11/1984 Pasley ..... A01D 11/06 172/372
4,535,987 A * 8/1985 Dikoff ..... A63B 57/00 116/225
4,700,423 A * 10/1987 Zuliani ..... 15/160
4,843,667 A * 7/1989 Hanly, Sr. ..... A01B 1/20 56/400.06
4,930,177 A * 6/1990 Rastutis ..... B44D 3/164 15/105
D348,500 S * 7/1994 Mortenson ..... B44D 3/164 15/105
5,388,824 A * 2/1995 Reimers ..... A63B 57/00 473/406
5,398,366 A * 3/1995 Bradley ..... 15/167.1
5,401,019 A * 3/1995 Wissman ..... A24F 13/22 33/555.2
5,509,167 A * 4/1996 Wilson ..... A47L 23/04 15/236.06
5,531,749 A * 7/1996 Michelson ..... A61B 90/00 606/93
5,694,660 A * 12/1997 Rachwalski ..... 15/237
5,720,105 A * 2/1998 Gates ..... B26B 9/00 30/162
5,752,285 A * 5/1998 Bendheim ..... A01B 1/20 172/378
5,759,120 A * 6/1998 Mathis ..... A63B 57/00 131/248
5,788,197 A * 8/1998 Tutela ..... A24F 13/22 131/257
5,794,495 A * 8/1998 Anderson ..... A01K 15/02 29/235
5,817,096 A * 10/1998 Salyer ..... A61B 17/1617 606/81
5,819,355 A * 10/1998 Wu ..... A46B 15/0055 15/106
5,819,750 A * 10/1998 Moyer ..... A24F 13/22 131/175
6,099,310 A * 8/2000 Bornstein ..... A61C 3/00 15/236.05
6,182,324 B1 * 2/2001 Pagliuzza ..... A63B 57/60 15/236.01
6,374,449 B1 * 4/2002 Jolly ..... 15/161
6,428,430 B1 * 8/2002 Chong ..... A63B 57/207 473/406
6,514,159 B2 * 2/2003 Hendren ..... A63B 57/207 473/282
6,543,388 B2 * 4/2003 Willinger et al. ..... 119/633
6,645,092 B1 * 11/2003 Hendren ..... A63B 57/207 473/285
D489,111 S * 4/2004 Perez ..... D21/795
6,796,913 B2 * 9/2004 Tummillo ..... A63B 57/50 473/408
6,837,807 B1 * 1/2005 Kerr ..... A63B 57/50 473/286
6,957,824 B2 * 10/2005 Klar ..... B60D 1/155 280/482
7,055,205 B2 * 6/2006 Aoyama ..... A46B 5/0075 15/167.1
7,134,263 B2 * 11/2006 Tedesco ..... A01D 11/06 56/400.04
7,189,166 B2 * 3/2007 Pare ..... A63B 55/10 172/378
7,437,793 B2 * 10/2008 Lane ..... 15/113
D592,857 S * 5/2009 Bohannon et al. ..... D4/118
7,527,563 B1 * 5/2009 Neu ..... A63B 57/50 248/156
7,621,819 B1 * 11/2009 Neu ..... B43L 23/06 172/375
7,731,728 B2 * 6/2010 Glaser ..... A61F 9/00736 606/161
7,841,041 B2 * 11/2010 Moskovich et al. ..... 15/167.1
7,845,042 B2 * 12/2010 Moskovich et al. ..... 15/167.1
7,942,756 B1 * 5/2011 Neu ..... A63B 55/10 172/375
7,958,590 B2 * 6/2011 Trefethren et al. ..... 15/147.1
D642,029 S * 7/2011 Rollinson ..... A63B 57/50 D8/26
7,975,346 B2 * 7/2011 Moskovich et al. ..... 15/167.1
8,011,051 B1 * 9/2011 Ba-Akeel et al. ..... 15/56
8,029,206 B2 * 10/2011 McCarthy ..... B65D 83/203 222/174
8,150,506 B2 * 4/2012 Kaushal ..... A61B 5/053 600/383
8,257,379 B2 * 9/2012 Lee ..... A61B 17/320036 606/170
8,302,246 B2 * 11/2012 Chudzik ..... A46B 7/023 132/119
D678,015 S * 3/2013 Paloheimo ..... D8/13
8,394,102 B2 * 3/2013 Garabedian ..... A61B 17/00234 606/279
D688,009 S * 8/2013 Mahoney, Jr. ..... D28/91.2
8,833,717 B1 * 9/2014 Holmes ..... F16M 13/00 15/1.7
9,101,386 B2 * 8/2015 Wallace ..... A61B 17/1659
2006/0016018 A1 * 1/2006 Hillenbrand ..... 7/156
2006/0101599 A1 * 5/2006 Lane ..... A46B 15/0055 15/113
2007/0056129 A1 * 3/2007 Bohannon ..... A46B 5/0095 15/111
2008/0268985 A1 * 10/2008 Wiens ..... A63B 57/50 473/408
2011/0030182 A1 * 2/2011 Jung ..... A63B 57/0037 29/278
2011/0201456 A1 * 8/2011 Schaaf ..... A63B 57/0068 473/408
2012/0046122 A1 * 2/2012 Kwon ..... A63B 57/60 473/283
2012/0317954 A1 * 12/2012 Landicini, Jr. ..... A01D 7/00 56/400.01

* cited by examiner

CAT'S CLAW GOLF TOOL WITH TREAD CLEANING

RELATED APPLICATIONS

The present application is a continuation in part of pending application Ser. No. 12/761,196 which was filed on Apr. 15, 2010.

FIELD OF THE INVENTION

This invention relates generally to the field of golfing accessories and more specifically to a multipurpose golf accessory tool.

BACKGROUND

The game of golf presents participants with a unique mixture of challenge and recreation. Overall, golf is widely embraced by the international population, and there is a continual desire to overcome the challenges inherent in the game thus increasing a golfer's enjoyment of the sport.

With an ever increasing population of golfers, professional and recreational alike, the sophistication of golf equipment has grown by leaps and bounds, all in an effort to simplify this difficult sport. Golf clubs have taken advantage of different materials, such as graphite, and shapes to increase power and accuracy. Golf balls are also now made from a multitude of materials offering a golfers improved distance and accuracy. Even golf apparel has changed to keep the golfer comfortable and allow the unrestricted movement of the golfer's body during a swing. Golf shoes too have seen an evolution over the life of the sport in material selection and design. The reason for this change in golf shoes can best be appreciated by first understanding a proper golf swing and then a review of at least partially advantageous golf shoes.

A proper golf swing requires a good foundation, stability and balance, each of which is made more difficult due to the great deal of rotational movement in the body of a golfer. Note that, the description of a golfer's swing is often described hereinafter for a right handed golfer. As will be appreciated, the principles of a golf swing operate similarly for a left handed golfer. At the beginning, a right-handed golfer's weight is evenly distributed between both sides of a golfer's body. During the backswing the golf club is swung back towards the foot furthest from the pin, the rear foot. As the golf club travels back towards the rear foot, the golfer's upper body begins to rotate and thus the club follows, sweeping up and out a generally circular path. This, in turn, causes a rotation of the hips (rear) which influences the rear leg and ultimately the rear foot. Looking down, the front portion of a golfer's rear foot is apt to rotate out, and the back portion of the rear foot is apt to rotate in, thus resulting in an overall clockwise (counter-clockwise for a left-handed golfer) rotation of the rear foot. The backswing continues until the club head reaches a desired point from which a downswing will impart a preferred force on the golf ball.

The golfer is now ready to begin the downswing during which the golf club will sweep out a similar circular path traversed through the backswing until it strikes the ball. As the golfer executes the downswing, the cleats of the golfer's shoes preferably brace the golfer. Unfortunately, however, known soft spike-type cleats provide only minimal bracing, as the cleats often times "roll over" or otherwise give as the torque of the golfer's body during a swing exerts forces thereon, as described further below.

During the follow through the golf club is carried forward and up causing a rotation in the upper body opposite the rotation of the backswing. During both the downswing and follow through weight is shifted towards the front leg. This action too causes a rotation in the front leg and ultimately the front foot. Looking down, the front portion of a golfer's front foot is apt to rotate out and the back portion of the front foot is apt to rotate in, thus resulting in an overall counter-clockwise (clockwise for a left-handed golfer) rotation of the front foot.

Spikes in the bottom sole of a golf shoe preferably operate to improve traction during these swing movements. If the spikes are successful then a golfer may see improved distance and accuracy. Many attempts have been made at designing spikes to serve this purpose each with inherent advantages and disadvantages.

Originally, golf shoes were made with metal spikes attached to the bottom soles. These spikes provided an adequate brace against the different forces of each foot associated with a golf swing. However, extending substantially entirely orthogonally to the sole of the shoe, such spikes do little to counter the above-described rotational movement of the golfer's feet. Moreover, these metal spikes often leave spike marks behind causing excessive damage to the golf course, especially the greens. In fact, many golf courses have taken the step of banning golfers from using metal spikes on their shoes. Therefore, though providing generally adequate bracing capabilities, a great deal of effort has gone into developing alternative material spikes that provide improved bracing capabilities while minimizing the divots left behind.

Many attempts have been made at using rubber spikes in the bottom sole of a golf shoe. These spikes have provided some bracing capabilities, and are more green friendly, but generally lack stiffness. Specifically, as noted previously, such spikes have a tendency to "roll-over" during play, and therefore do not adequately counter rotational movement of a golfer's foot. Moreover, as a result, the spikes often break or fray and thus have to be replaced all too frequently.

As a golfer walks a golf course and the surrounding areas he encounters a multitude of surfaces; grass, sand, mud, rock, and cement, to name a few. Grass and mud often get caught in the spikes, especially as they roll over, thus causing the bracing provided by the shoes to be further compromised. With respect to harder surfaces, they have a tendency to wear down rubber spikes more quickly. For example, cement is likely the most damaging surface and it is often encountered when the golfer is entering and leaving the course.

Most of these spikes have a circular base with multiple barbs extending from the base to the ground. Often these barbs are placed peripherally around the outside edge of the circular base forming a spike. However, many of these spikes have blunt, bulky barbs that are unable to penetrate the plethora of surfaces encountered on a golf course. In sum, these spikes cannot provide adequate resistance to the rotational movement of a golfer's feet associated with a golf swing.

What is missing in the field of golf shoes and spikes is an apparatus which is appropriately designed to allow a golfer's shoe to engage one or more types of surfaces encountered on a golf course, provide improved bracing (e.g., minimize "roll over"), and resist and release appropriately in response to rotational movement of a golfer's feet during a golf swing, while also being readily retrofittable to most any golf shoe. Conventional plastic cleats especially fail against metal spikes in providing grip on wet grass, withered grass or slopes. The plastic cleats are known to be far more difficult to keep clean, which is a concern of golfers playing in adverse weather conditions. Some manufacturer's recognize this problem and supply special cleaning tools for keeping the spikes clean of debris. This invention relates generally to the field of golfing accessories and more specifically to a multipurpose golf accessory tool.

SUMMARY

A golf tool for cleaning a cleat or spike may include a top surface, a pair of opposing side surfaces connected to the top surface, a bottom surface opposing the top surface, a front surface connecting to the top surface, the bottom surface and the side surfaces, and a back surface connecting to the top surface, the bottom surface and the side surfaces.

The bottom surface may be connected to at least three cleaning fingers to simultaneously clean three cleats of a golf shoe.

The top surface may include a first concave surface, and the top surface may include a second concave surface.

The top surface may include a traverse upward extending projection, and the top surface may include an inclined portion.

The bottom surface may include a traverse downward extending projection, and the bottom surface may include a concave portion surface.

The side surface may include a depression.

The front surface may be connected to a finger projection having a flexible cleaning cylinder.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
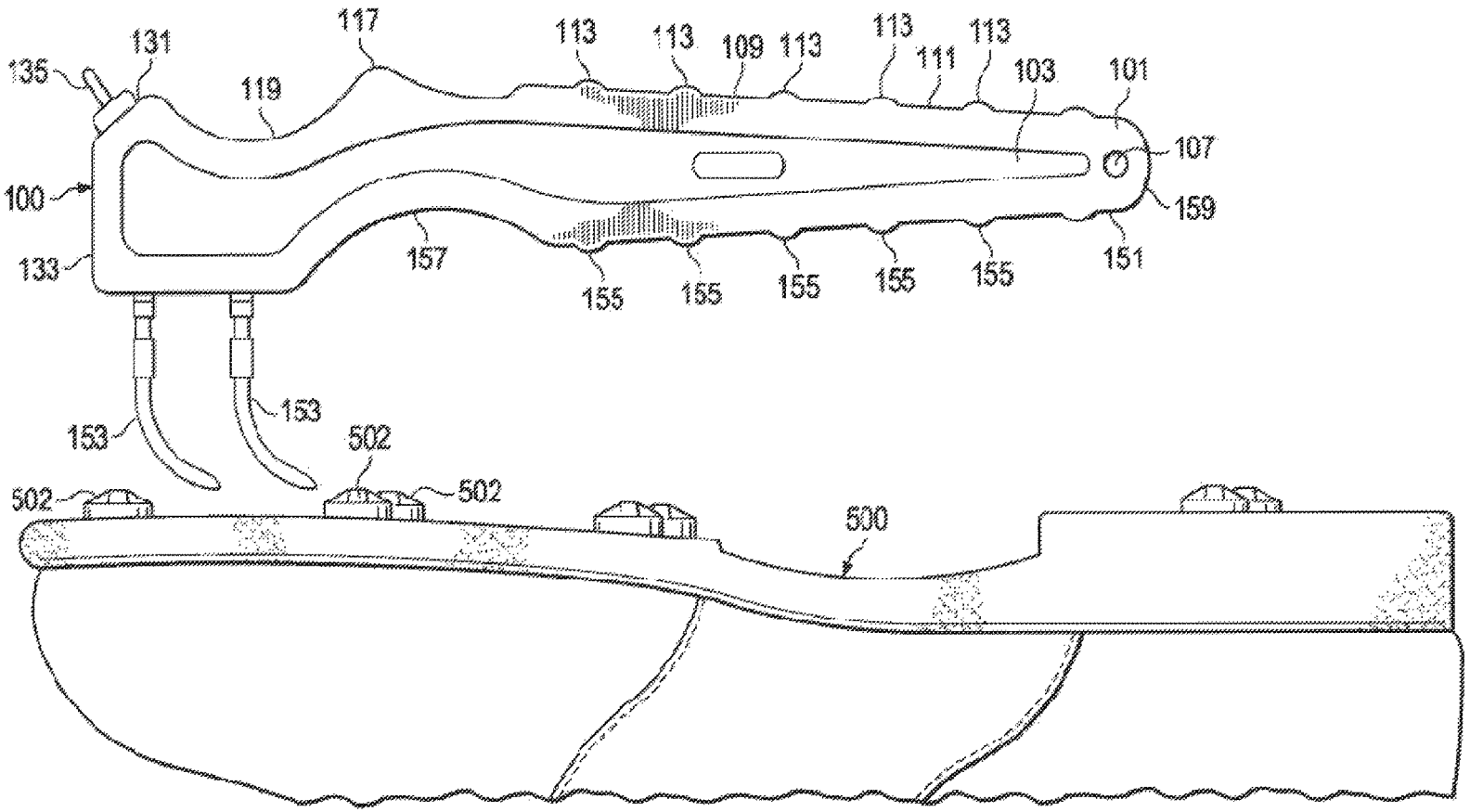
FIG. 1 illustrates a side view of the golf tool of the present invention.

FIG. 1 illustrates a side view of the golf tool 100 which may be referred to as a cats claw golf tool and which may cooperate with cleats 502 or spikes which may be found on the bottom surface of the golf shoe 500. The golf tool 100 may aggressively remove grass, dirt or other types of debris which may be found on the golf course. FIG. 1 illustrates the side surface 101 of the golf tool 100 which may be mirrored on the opposing side surface and which may include a longitudinal depression 103 which may extend substantially the length of the golf tool 100. The longitudinal depression 103 may include an upward extending projection 105 which may be positioned at a approximate center of the longitudinal depression 103. The side surface 101 may include an aperture 107 at an approximate end of the golf tool 100 in order to connect to a additional hanging device (not shown) to allow the golf tool 100 to be stowed on the exterior of the golf bag (not shown).

FIG. 1 additionally illustrates the top surface 109 which may be connected to the side surface 101 and which may include an inclined surface portion 111 which may extend from the proximate end of the golf tool 100 and which may include the traverse upward extending projections 113 which may be positioned to aid in gripping the golf tool 100. The top surface 109 may include a first concave (or depression) surface 115 which may be defined by the distal end of the inclined surface 111 and a upward extending surface portion 117, and the top surface 109 may include a second concave (or depression) surface 119 which may be defined by the upward extending surface portion 117 and a second inclined surface portion 131 which may extend to the front surface 133 which may be positioned at the distal end of the golf tool 100.

The inclined surface portion 131 may be connected to an outward extending tool 135 to be used to clean golf instruments.

The golf tool 100 maybe formed from rigid material such as metal, plastic, wood or other appropriate materials and the golf tool 100 may include a first cleaning finger 153, a second cleaning finger 153 and a third cleaning finger 153 which may be positioned so that the distal end of each of the first cleaning finger 153 the second cleaning finger 153 and the third cleaning finger 153 is positioned to simultaneously clean a first cleat 502, a second cleat 502 and a third cleat 502 which may be positioned on the sole of the golf shoe 500. The present invention may include only a first cleaning finger 153 and a second cleaning finger 153 or may include four cleaning fingers 153 or more cleaning fingers. The present invention may clean all the cleats 502 on the sole of the golf shoe 500 simultaneously and as a result time is saved for the user. The user is subsequently able to return to the game. The present invention may only include a first cleaning finger and 103 and a second cleaning FIG. 153.

The bottom surface 151 may include traverse downward extending projections 155 to provide additional gripping of the golf tool 100 and may include a concave surface portion 157 (or a depression) for placement of a finger of the user.

The back surface 159 may connect the bottom surface 151, the top surface 109 and the side surface 101 and the back surface 159 opposes the front surface 133.

Figure 2:
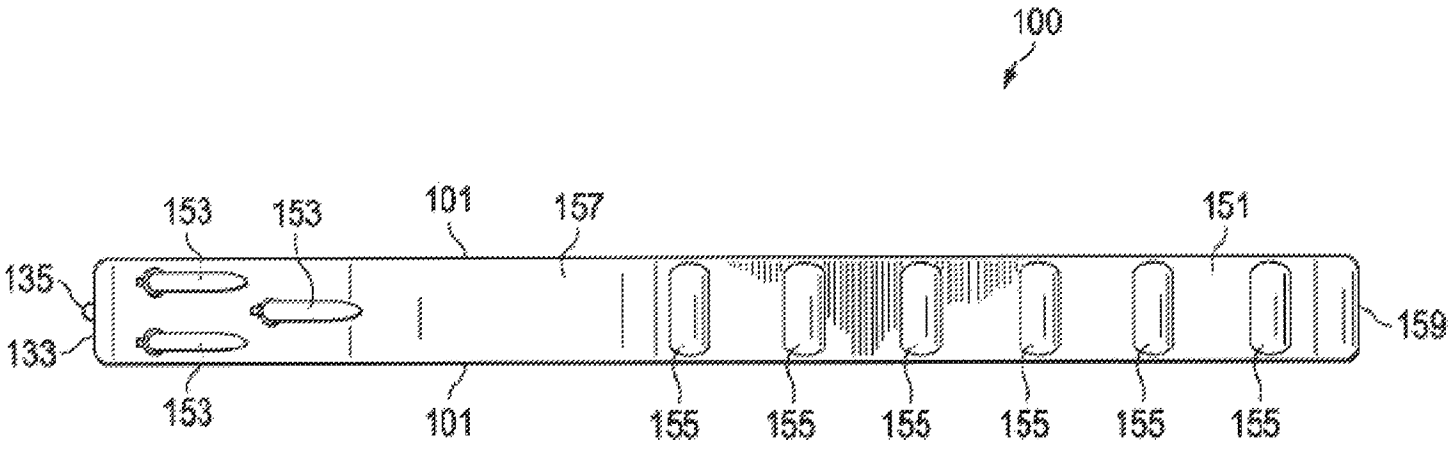
FIG. 2 illustrates a bottom view of the golf tool of the present invention.

FIG. 2 illustrates a bottom view of the golf tool 100 of the present invention and illustrates opposing side surfaces 155, a back surface 159 and a front surface 133. FIG. 2 additionally illustrates the traverse downward extending projections 155 and the concave surface portion 159 and the downward extending cleaning fingers 153 which may be positioned at a distal end of the golf tool 100.

Figure 3:
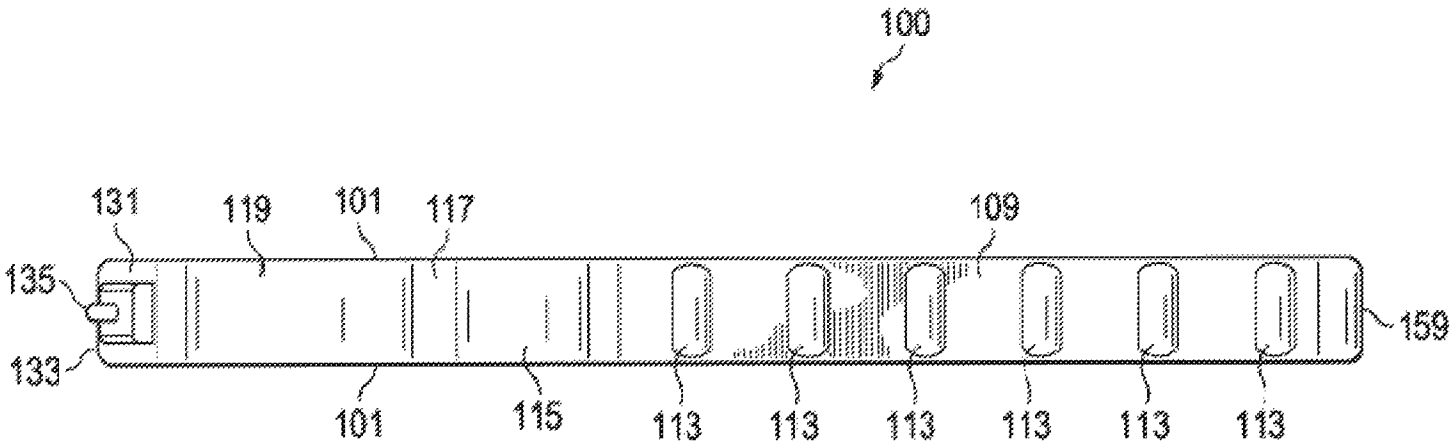
FIG. 3 illustrates a top view of the golf tool of the present invention.

FIG. 3 illustrates a top view of the golf tool 100 and illustrates a side surface 101, an opposing side surface 101, a back surface 159, a front surface 133 and a top surface 109.

FIG. 3 additionally illustrates the traverse upward extending projection member 113 the first concave surface 115, the second concave surface 119 and the upward extending surface portion 117. FIG. 3 illustrates the inclined portion 131.

Figure 4:
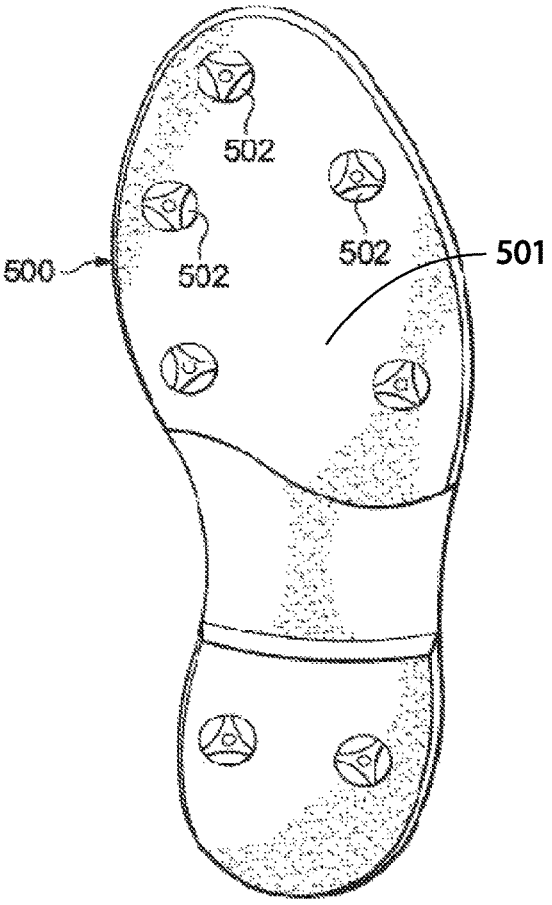
FIG. 4 illustrates a bottom view of a golf shoe.

FIG. 4 illustrates a bottom view of the golf shoe 500 which may include cleats 502 which may be formed in any approximate triangular shape.

Figure 5:
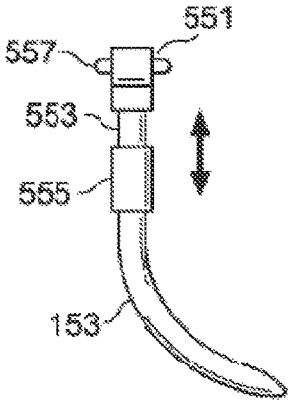
FIG. 5 illustrates a detachably connected finger of the present invention.

FIG. 5 illustrates a side view of the cleaning finger 153 of the present invention. The cleaning finger 153 may include a first telescoping section 153 and a second telescoping section 155 which may retract or extend within the first telescoping section 153 in order to longitudinally extend or retract the reach of the cleaning finger 153. Additional telescoping sections are within the scope of the invention. FIG. 5 additionally illustrates a pivoting point 551 to allow the cleaning finger 153 to pivot about a shaft 557 in order to allow the cleaning FIG. 153 to move radially (side to side). The combination of the telescoping movement and the pivoting movement allow for the cleaning FIG. 153 to be adjustably moved in order to compensate for different cleat 502 positions.

Figure 6:
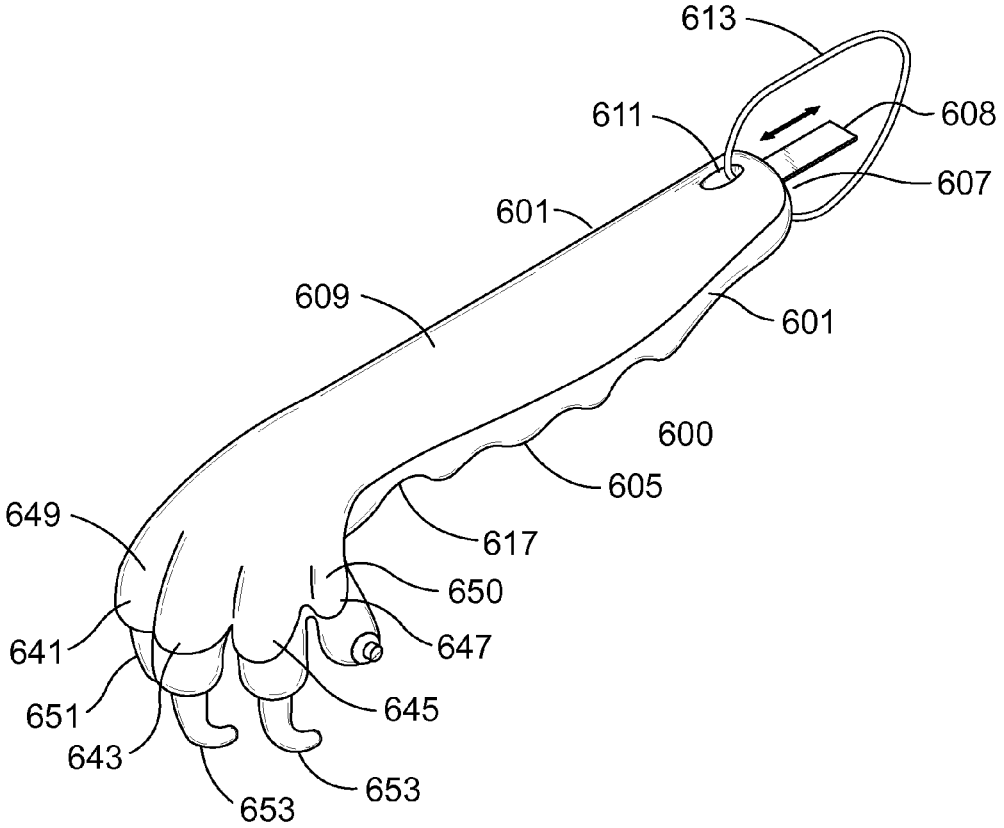
FIG. 6 illustrates a perspective view of another golf tool of the present invention.

FIG. 6 illustrates a perspective view of another golf tool 600 which may be referred to as a cats claw golf tool and which may cooperate with cleats 502 or spikes which may be found on the bottom surface of the golf shoe 500. The golf tool 600 may aggressively remove grass, dirt or other types of debris which may be found on the golf course. FIG. 6 illustrates the side surface 601 of the golf tool 600 which may be mirrored on the opposing side surface with an opposing side surface 601. The side surface 601 may be concavely shaped in order to provide an ergonomic grip for the user and may be connected to the bottom surface 605.

FIG. 6 additionally illustrates the top surface 609 which may be connected to the side surface 601. The top surface 609 may include an aperture 611 which may extend through the golf tool 600 to the bottom surface 605 to allow a string 613 or cord to be attached so that the golf tool 600 may be attached to a clip to hang on a golf bag. The top surface 609, the bottom surface 605 and the side surface 601 may be connected to a back surface 607 and a front surface 619.

The back surface 607 may include a longitudinal arm which may extend outwards along the longitudinal axis of the golf tool 600 and which may include a sharpened edge to act as a scraper to clean the side of the golf shoe.

Figure 7:
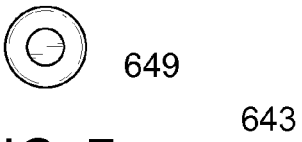
FIG. 7 illustrates a bottom view of a finger projection of the golf tool.

The golf tool 600 maybe formed from rigid material such as metal, plastic, wood or other appropriate materials and the golf tool 600 may include (at the distal end of the golf tool 600) a cat claw (or hand shaped) shaped device 651 which may include multiple finger projections 641, 643, 645, 647 which may include a substantially circular cross-section and which may extend downwards and which may be curved. The finger projections 641, 643 645, 647 may include an aperture 649 as illustrated in FIG. 7 for the finger projection 643. Each of the finger projections may include the aperture 649 to detachably connect to a cleaning finger 653. The first finger projection 641 may be detachably connected to a first cleaning finger 653; the second finger projection 643 may be detachably connected to a second cleaning finger 653 and the third finger projection 645 may be detachably connected to a third cleaning finger 653 which may be positioned so that the distal end of each of the first cleaning finger 653 the second cleaning finger 153 and the third cleaning finger 653 is positioned to simultaneously clean a first cleat 502, a second cleat 502 and a third cleat 502 which may be positioned on the sole of the golf shoe 500. The first second and third cleaning finger 651, 653, 655 may be curved or substantially straight and may be rigid with a sharpened point. The present invention may include only a first cleaning finger 653 and a second cleaning finger 653 or may include four cleaning fingers 653 or more cleaning fingers. The present invention may clean all the cleats 502 on the sole of the golf shoe 500 simultaneously and as a result time is saved for the user. The user is subsequently able to return to the game. The present invention may only include a first cleaning finger 651 and a second cleaning FIG. 653.

The golf shoe 500 may include tread 501 which may be formed as grooves in the sole of the golf shoe 500 and which may aid in traction especially on slippery surfaces. These treads 501 may be filled with debris and result in the function of the tread being diminished. In order to clean the tread 501, the fourth finger projection 647 may include a cleaning cylinder 657 which may extend from and be detachably connected to the fourth finger projection 647 in order to cooperate and clean the tread 501. The cleaning cylinder 657 may be formed from flexible material such as rubber, plastic or the like and may form a rubber nub to clean between the treads of the golf shoe.

Figure 8:
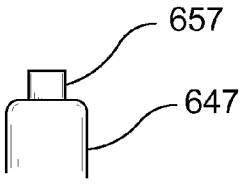
FIG. 8 illustrates a side view of the finger projection of the golf tool.

FIG. 8 illustrates the cleaning cylinder 657 and the fourth projection 647.

FIG. 6 additionally illustrates a bottom surface 605 which may include traverse depressions 617 in order to facilitate the grip of the user on the golf tool 600.

Figure 9:
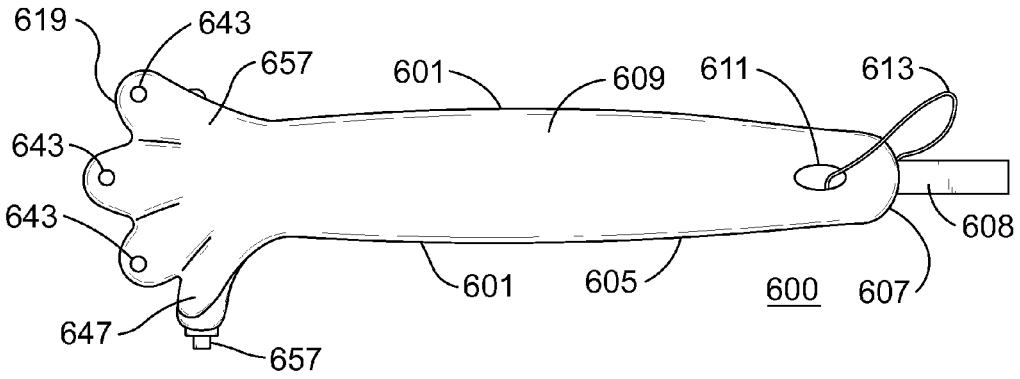
FIG. 9 illustrates a top view of the golf tool of the present invention.

FIG. 9 illustrates a top view of the golf tool 600 which may be referred to as a cats claw golf tool and which may cooperate with cleats 502 or spikes which may be found on the bottom surface of the golf shoe 500. The golf tool 600 may aggressively remove grass, dirt or other types of debris which may be found on the golf course. FIG. 9 illustrates the side surface 601 of the golf tool 600 which may be mirrored on the opposing side surface with an opposing side surface 601. The side surface 601 may be concavely shaped in order to provide an ergonomic grip for the user and may be connected to the bottom surface 605.

FIG. 9 additionally illustrates the top surface 609 which may be connected to the side surface 601. The top surface 609 may include an aperture 611 which may extend through the golf tool 600 to the bottom surface 605 to allow a string 613 or cord to be attached so that the golf tool 600 may be attached to a clip to hang on a golf bag. The top surface 609, the bottom surface 605 and the side surface 601 may be connected to a back surface 607 and a front surface 619.

The back surface 607 may include a longitudinal arm 608 which may extend outwards along the longitudinal axis of the golf tool 600 and which may include a sharpened edge to act as a scraper to clean the side of the golf shoe.

The back surface 607 may connect the bottom surface 605, the top surface 609 and the side surface 601 and the back surface 607 opposes the front surface 619.

The golf tool 600 may include (at the distal end of the golf tool 600) a cat claw (or hand shaped) shaped device 651 which may include multiple finger projections 641, 643, 645, 647 which may include a substantially circular cross-section and which may extend downwards and which may be curved. The finger projections 641, 643 645, 647 may include an aperture 649 as illustrated in FIG. 7 for the finger projection 643. Each of the finger projections may include the aperture 649 to detachably connect to a cleaning finger 653. The first finger projection 641 may be detachably connected to a first cleaning finger 653; the second finger projection 643 may be detachably connected to a second cleaning finger 653 and the third finger projection 645 may be detachably connected to a third cleaning finger 653 which may be positioned so that the distal end of each of the first cleaning finger 653 the second cleaning finger 153 and the third cleaning finger 653 is positioned to simultaneously clean a first cleat 502, a second cleat 502 and a third cleat 502 which may be positioned on the sole of the golf shoe 500. The first second and third cleaning finger 651, 653, 655 may be curved or substantially straight and may be rigid with a sharpened point.

The fourth finger projection 647 may include a cleaning cylinder 657 which may extend from and be detachably connected to the fourth finger projection 647 in order to cooperate and clean the tread 501.

Figure 10:
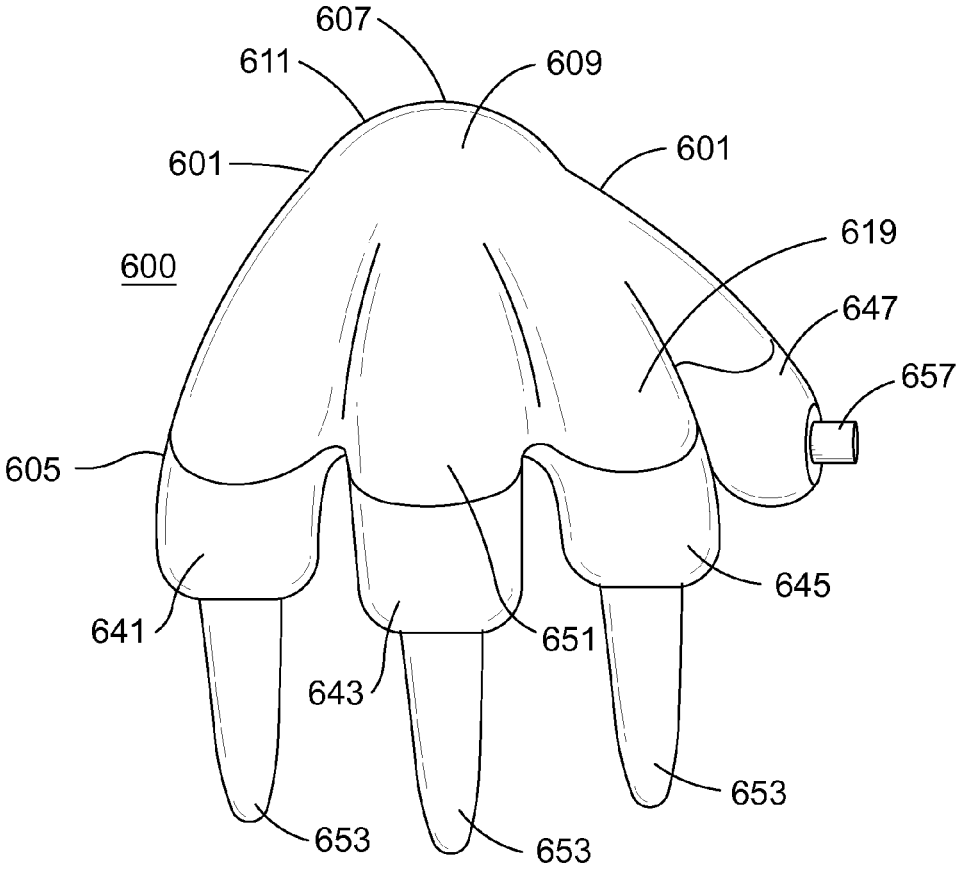
FIG. 10 illustrates a front view of the golf tool of the present invention.

FIG. 10 additionally illustrates the top surface 609 which may be connected to the side surface 601. The top surface 609 may include an aperture 611 which may extend through the golf tool 600 to the bottom surface 605 to allow a string 613 (see FIG. 6) or cord to be attached so that the golf tool 600 may be attached to a clip to hang on a golf bag. The top surface 609, the bottom surface 605 and the side surface 601 may be connected to a back surface 607 and a front surface 619.

The back surface 607 may include a longitudinal arm 608 (see FIG. 6) which may extend outwards along the longitudinal axis of the golf tool 600 and which may include a sharpened edge to act as a scraper to clean the side of the golf shoe.

The back surface 607 may connect the bottom surface 605, the top surface 609 and the side surface 601 and the back surface 607 opposes the front surface 619.

The golf tool 600 may include (at the distal end of the golf tool 600) a cat claw (or hand shaped) shaped device 651 which may include multiple finger projections 641, 643, 645, 647 which may include a substantially circular cross-section and which may extend downwards and which may be curved. The finger projections 641, 643 645, 647 may include an aperture 649 as illustrated in FIG. 7 for the finger projection 643. Each of the finger projections may include the aperture 649 to detachably connect to a cleaning finger 653. The first finger projection 641 may be detachably connected to a first cleaning finger 653; the second finger projection 643 may be detachably connected to a second cleaning finger 653 and the third finger projection 645 may be detachably connected to a third cleaning finger 653 which may be positioned so that the distal end of each of the first cleaning finger 653 the second cleaning finger 153 and the third cleaning finger 653 is positioned to simultaneously clean a first cleat 502, a second cleat 502 and a third cleat 502 which may be positioned on the sole of the golf shoe 500. As a consequence of being able to simultaneously clean the first cleat 502, the second cleat 502 and the third group will cleat 502 the golf tool 500 600 quickly cleans the golf shoe and avoids the need to individually clean each cleat 502. The first second and third cleaning finger 651, 653, 655 may be curved or substantially straight and may be rigid with a sharpened point.

The fourth finger projection 647 may include a flexible cleaning cylinder 657 which may extend from and be detachably connected to the fourth finger projection 647 in order to cooperate and clean the tread 501.

Figure 11:
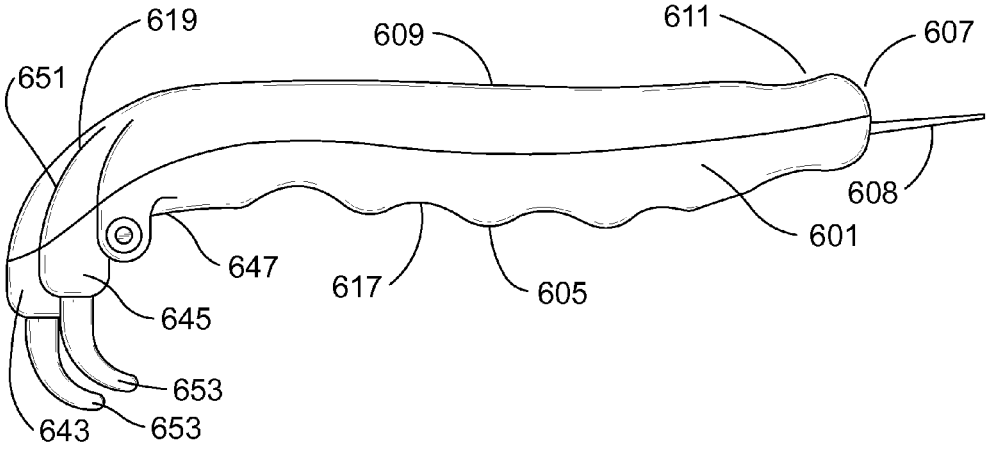
FIG. 11 illustrates a side view of the golf tool of the present invention.

FIG. 11 illustrates a side view of the golf tool 600 and illustrates the back surface 607, the bottom surface 605, the side surface 601, the front surface 619 and the top surface 609.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A golf tool for cleaning a cleat or spike, comprising:

a top surface;

a pair of opposing side surfaces connected to the top surface;

a bottom surface opposing the top surface;

a front surface connecting to the top surface, the bottom surface and the pair of opposing side surfaces;

a back surface connecting to the top surface, the bottom surface and the pair of opposing side surfaces;

wherein the front surface is connected to at least three stationary finger projections which extend downward and which are curved, and wherein each of said at least three stationary finger projections are connected to a stationary cleaning finger to simultaneously clean cleats of a golf shoe;

wherein said at least three stationary finger projections cleaning fingers are located on a distal end of said golf tool;

wherein the front surface is connected to a finger projection having cleaning cylinders;

wherein said at least three stationary finger projections have a substantially circular cross-section;

wherein said at least three stationary finger projections are directly attached to said front surface at a first end and are directly attached to said stationary cleaning fingers at a second end; and wherein said at least three stationary finger projections are substantially perpendicular to said top surface.

2. A golf tool for cleaning a cleat or spike as in claim 1, further comprising of a longitudinal arm to scrape the golf shoe, wherein said longitudinal arm is approximately perpendicular to said stationary cleaning fingers.

3. A golf tool for cleaning a cleat or spike as in claim 1 wherein said stationary cleaning fingers extend downward and are curved.

4. A golf tool for cleaning a cleat or spike as in claim 3 wherein said stationary cleaning fingers comprise a sharpened point.

5. A golf tool for cleaning a cleat or spike as in claim 3 wherein said stationary cleaning fingers are rigid.

6. A golf tool for cleaning a cleat or spike as in claim 1 wherein said at least three stationary finger projections further comprise an aperture.

7. A golf tool for cleaning a cleat or spike as in claim 1 wherein said at least three stationary finger projections comprise an aperture to detachably connect to said stationary cleaning fingers.

* * * * *